US011063384B2

(12) United States Patent
Zheng

(10) Patent No.: US 11,063,384 B2
(45) Date of Patent: Jul. 13, 2021

(54) CONNECTOR

(71) Applicant: Dianqing Zheng, Guangzhou (CN)

(72) Inventor: Dianqing Zheng, Guangzhou (CN)

( * ) Notice: Subject to any disclaimer, the term of this patent is extended or adjusted under 35 U.S.C. 154(b) by 0 days.

(21) Appl. No.: 16/802,857

(22) Filed: Feb. 27, 2020

(65) Prior Publication Data

US 2021/0013665 A1 Jan. 14, 2021

(30) Foreign Application Priority Data

Jul. 11, 2019 (CN) ..... 201921089171.0

(51) Int. Cl.
*H01R 13/502* (2006.01)
*H01R 13/14* (2006.01)

(52) U.S. Cl.
CPC ..... *H01R 13/502* (2013.01); *H01R 13/14* (2013.01)

(58) Field of Classification Search
CPC ..... H01R 13/14; H01R 13/502; H01R 24/84; H01R 13/28; H01R 31/06
See application file for complete search history.

(56) References Cited

U.S. PATENT DOCUMENTS 1,901,040 A * 3/1933 Peroni ..... H01R 24/58 200/51.09

* cited by examiner

*Primary Examiner* — Oscar C Jimenez
(74) *Attorney, Agent, or Firm* — Bayramoglu Law Offices LLC

(57) ABSTRACT

A connector includes a first connecting assembly and a second connecting assembly, wherein the first connecting assembly and the second connecting assembly are fitted with each other. The first connecting assembly includes a first inner core and at least two first electric wires, and each of the first electric wires is electrically connected in a first end portion of the first inner core. The second connection assembly includes a second inner core and at least two second electric wires, and each of the second electric wires is electrically connected in a first end portion of the second inner core. A second end portion of the second inner core is provided with a connecting portion, and the connecting portion is inserted in a second end portion of the first inner core, so that the first electric wire is in an electrical communication with the second electric wire.

8 Claims, 3 Drawing Sheets

CONNECTOR

CROSS REFERENCE TO THE RELATED APPLICATIONS

This application is based upon and claims priority to Chinese Patent Application No. 201921089171.0, filed on Jul. 11, 2019, the entire contents of which are incorporated herein by reference.

TECHNICAL FIELD

The present invention relates to the technical field of electrical connection inside a Christmas tree tube, and more particularly relates to a connector.

BACKGROUND

For a Christmas tree, it is usually necessary to install light strings and decorations to decorate the Christmas tree. In order to ensure that all the light strings can be lit, a commonly used method is to connect sequentially multiple segments of electric wires inside the Christmas tree tube, thereby achieving communication of the light strings on the entire Christmas tree. Generally, the prior art in the market is that two-stage wires are connected and powered-on, and the functions of the two-stage wires are relatively simple. Moreover, when two segments of two-stage electric wires are connected, the installation in the connector needs to be positioned in a specified direction, which is very inconvenient during the actual use.

SUMMARY

Based on the above disadvantages of the prior art, an objective of the present invention is to provide a connector, and the connector can realize effective connection between multi-stage electric wires, making the functions more abundant and ensuring the reliability of the power-on use. Moreover, there is no need to specify the direction, and the operation is simple.

Based on this, the technical solution of the present invention is as follows. A connector includes a first connecting assembly and a second connecting assembly, wherein the first connecting assembly and the second connecting assembly are fitted with each other.

The first connecting assembly includes a first inner core and at least two first electric wires, and each of the first electric wires is electrically connected in a first end portion of the first inner core.

The second connecting assembly includes a second inner core and at least two second electric wires, and each of the second electric wires is electrically connected in a first end portion of the second inner core.

A second end portion of the second inner core is provided with a connecting portion, and the connecting portion is inserted in a second end portion of the first inner core, so that the first electric wire is in an electrical communication with the second electric wire.

Optionally, the first electric wires are arranged side by side, and the second electric wires are arranged side by side.

Optionally, an output terminal in an electrical communication with each of the first electric wires is arranged inside the first inner core. The connecting portion is electrically connected to each of the second electric wires, and the connecting portion is inserted into the second end portion of the first inner core and is electrically connected to the output terminal.

Optionally, a limiting hole is arranged in the second end portion of the first inner core. A first end portion of the connecting portion is fixedly connected on the second end portion of the second inner core, and a second end portion of the connecting portion is inserted into the limiting hole. The outer side surface of the second end portion of the connecting portion is an arc-shaped surface.

Optionally, the first connecting assembly includes a first housing. The first electric wires are arranged inside the first housing, and the first inner core is arranged at a first end portion of the first housing in a penetration manner.

The second connecting assembly includes a second housing. The second electric wires and the second inner core are each arranged inside the second housing, and the connecting portion is arranged at a first end portion of the second housing in a penetration manner.

A positioning hole cooperating with the first inner core is arranged in the first end portion of the second housing, the first inner core extends into the positioning hole, and the connecting portion is inserted into the second end portion of the first inner core.

Optionally, the connector further includes an elastic member. A first end portion of the elastic member is fixedly connected to the first end portion of the first inner core, a second end portion of the elastic member is fixedly connected to the first housing, and the elastic member is sleeved on the outer side of the first electric wires.

Optionally, the elastic member is a spring.

Optionally, the first housing includes a first segment and a second segment, wherein the inner diameter of the first segment is smaller than the inner diameter of the second segment, and the first segment and the second segment are sequentially connected. The first inner core is arranged at a first end portion of the second segment in a penetration manner.

The second housing includes a third segment and a fourth segment, wherein the inner diameter of the third segment is larger than the inner diameter of the fourth segment, and the third segment and the fourth segment are sequentially connected. The second inner core is located in the fourth segment, and the positioning hole and the connecting portion are both arranged in the third segment.

The first end portion of the second segment is fixedly connected to a first end portion of the third segment.

Optionally, the elastic member is located in the second segment. A step is provided at a connection between the inner wall of the first segment and the inner wall of the second segment, and a second end portion of the elastic member is abutted and connected to the step.

Optionally, the first housing includes two first half housings, wherein the two first half housings are detachably engaged. The second housing includes two second half housings, wherein the two second half housings are detachably engaged.

The implementation of the embodiments of the present invention has the following advantages.

The connector of the present invention includes a first connecting assembly and a second connecting assembly, which are fitted with each other. The first connecting assembly includes a first inner core and at least two first electric wires, and each of the first electric wires is electrically connected in a first end portion of the first inner core. The second connection assembly includes a second inner core and at least two second electric wires, and each of the second electric wires is electrically connected in a first end portion of the second inner core. A second end portion of the second inner core is provided with a connecting portion, and the connecting portion is inserted in a second end portion of the first inner core, so that the first electric wire is in an electrical communication with the second electric wire. Thus, the multi-stage connection powered-on inside the Christmas tree tube can be ensured, and it is convenient for the powered-on connection in the tube to achieve more diverse functions. The structural design of the entire connector is very simple, making it convenient to produce and manufacture and easy to install, use and operate. When two segments of multi-stage electric wires need to be conducted, only the first connecting assembly and the second connecting assembly need to be simply spliced, which effectively ensures the reliability of the electrical connection between various electric wires in the tube and makes it suitable for promotion and use.

1. first connecting assembly, 11. first inner core, 12. first electric wire, 13. first housing, 131. first segment, 132. second segment, 2. second connecting assembly, 21. second inner core, 22. connecting portion, 23. second housing, 231. third segment, 232. fourth segment, 24. second electric wire, 3. limiting hole, 4. positioning hole, 5. elastic member, 6. step, 7. first bump, 8. first groove, 9. second bump, 10. second groove.

DETAILED DESCRIPTION OF THE EMBODIMENTS

The technical solutions in the embodiments of the present invention are clearly and completely described below with reference to the accompanying drawings in the embodiments of the present invention. Obviously, the described embodiments are only a part of the embodiments of the present invention, and not all the embodiments. All other embodiments obtained by those skilled in the art based on the embodiments of the present invention without creative efforts shall fall within the protective scope of the present invention.

In the description of the present invention, it should be understood that the orientations or positional relationships indicated by the terms such as "up", "down", "left", and "right" are based on the orientations or positional relationships shown in the accompanying drawings, which is only for the purpose of facilitating the description of the present invention and simplifying the description, rather than indicating or implying that the device or element referred to must have a specific orientation, and construct and operate in the specific orientation. Therefore, these cannot be understood as a limitation on the present invention.

Figure 1:
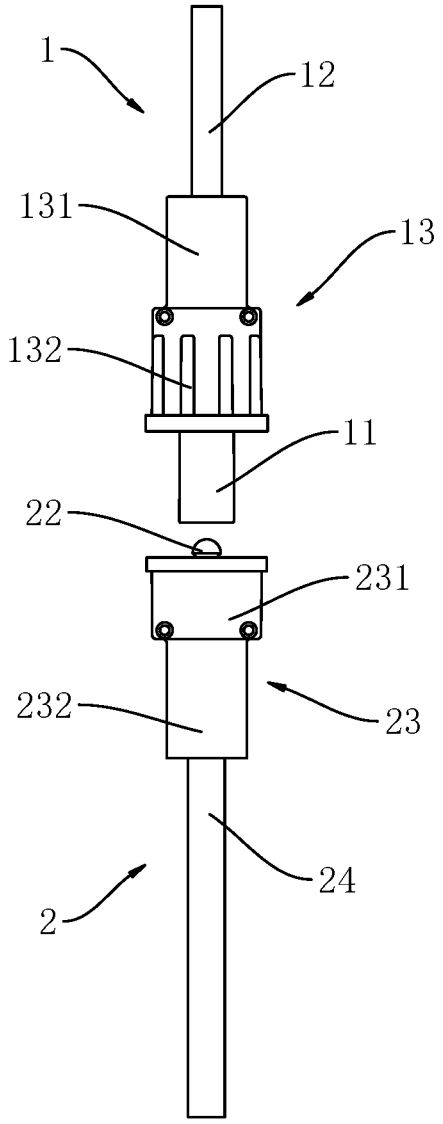
FIG. 1 is a schematic diagram of an overall structure of a connector according to an embodiment of the present invention.
Figure 2:
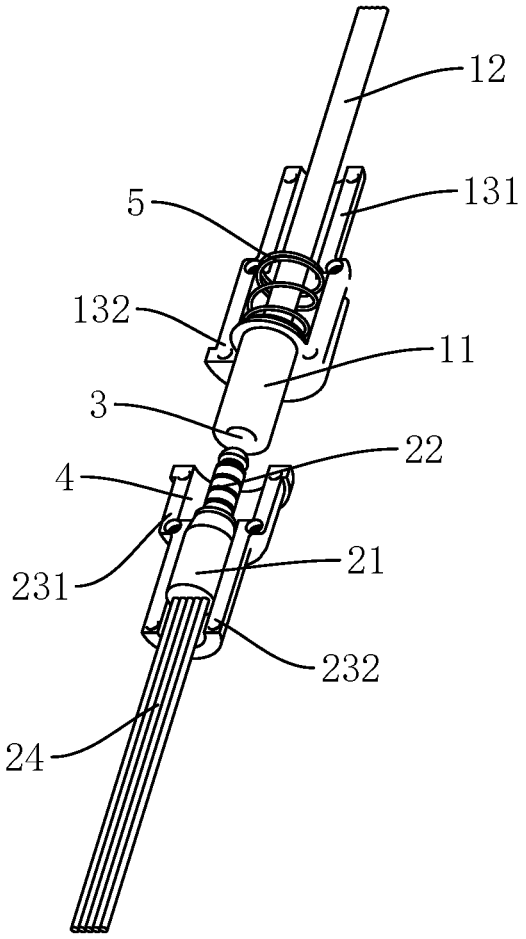
FIG. 2 is a schematic diagram of an axonometric structure of the connector according to the embodiment of the present invention after a first half housing and a third half housing are hidden.
Figure 3:
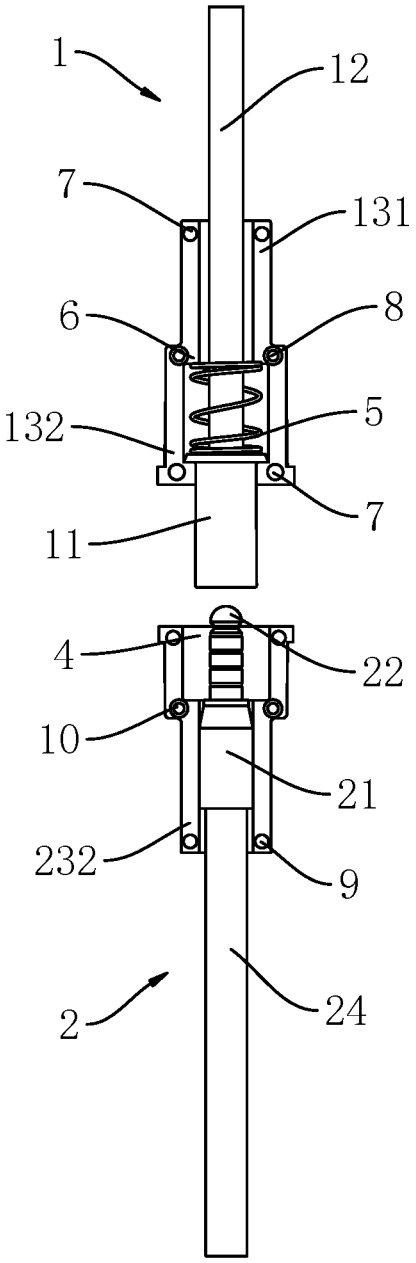
FIG. 3 is a schematic diagram of a front view structure of the connector according to the embodiment of the present invention after the first half housing and the third half housing are hidden.

Refer to FIGS. 1 to 3. According to a preferred embodiment of the present invention, a connector includes the first connecting assembly 1 and the second connecting assembly 2, which are fitted with each other. The first connecting assembly 1 includes the first inner core 11 and at least two first electric wires 12, and each of the first electric wires 12 is electrically connected in a first end portion of the first inner core 11. The second connecting assembly 2 includes the second inner core 21 and at least two second electric wires 24, and each of the second electric wires 24 is electrically connected in a first end portion of the second inner core 21. A second end portion of the second inner core 21 is provided with the connecting portion 22, and the connecting portion 22 is inserted in a second end portion of the first inner core 11, so that the first electric wire 12 is in an electrical communication with the second electric wire 24.

Based on the above structure, when the connector is used, multiple segments of electric wires need to be connected in the Christmas tree tube to ensure the normal operation of decorations such as light strings installed on the Christmas tree tube. The connector can effectively electrically conduct two adjacent electric wires, wherein the first connecting assembly 1 is first positioned in the Christmas tree tube, and then the connecting portion 22 of the second connecting assembly 2 is inserted into the first inner core 11 of the first connecting assembly 1. The at least two first electric wires 12 are electrically connected in the first inner core 11, the at least two second electric wires 24 are electrically connected in the second inner core 21, and during the conduction process of the connecting portion 22 and the first inner core 11, each of the first electric wires 12 in the first connecting assembly 1 and each of the second electric wires 24 in the second connecting assembly 2 can be conducted correspondingly. In the present embodiment, both the number of the first electric wires 12 and the number of the second electric wires 24 are five, so that the five-stage connection powered-on is achieved, which provides a reliable basis for enabling more abundant functions to be achieved. The structure design of the connector is simple and the operation is convenient. In the multi-segment connection in the Christmas tree tube, the first connecting assembly 1 and the second connecting assembly 2 are only simply engaged with each other by the connector, so as to achieve the corresponding electrical connection. The connector has reliable principle and is easy to use.

Specifically, the first electric wires 12 are arranged side by side, and the second electric wires 24 are arranged side by side. The arrangement of each of the first electric wires 12 and each of the second electric wire 24 make it more reliable and convenient for multi-stage connection powered on, and the conduction connection between the multi-stage electric wires is more convenient. An output terminal in an electrical communication with each of the first electric wires 12 is arranged inside the first inner core 11, the connecting portion 22 is electrically connected to each of the second electric wires 24, and the connecting portion 22 is inserted in the second end portion of the first inner core 11 and is electrically connected to the output terminal. Each of the second electric wires 24 is electrically connected to the connecting portion 22, that is, the connecting portion 22 can be used as a connection terminal of five-stage electric wires and connected to the first inner core 11. Each of the first electric wires 12 in the first inner core 11 is connected to the output terminal, thereby achieving the electrical conduction between the first electric wire 12 and the second electric wire 24 by contacting the connecting portion 22 with the output terminal. The structure design is simple and the conduction is convenient. The limiting hole 3 is arranged in the second end portion of the first inner core 11. A first end portion of the connecting portion 22 is fixedly connected to the second end portion of the second inner core 21, and a second end portion of the connecting portion 22 is inserted in the limiting hole 3. The output terminal is located in the limiting hole 3, and the second end portion of the connecting portion 22 is inserted into the limiting hole 3 to be electrically connected to the output terminal. The limiting hole 3 can ensure a stable connection between the connecting portion 22 and the first inner core 11, which is convenient for an operator to quickly position the connecting portion 22 when connecting the connecting portion 22 and the first inner core 11, thereby improving the efficiency of installation and connection. The outer side surface of the second end portion of the connecting portion 22 is an arc-shaped surface. The arc-shaped structure design can ensure 360-degree docking connection of the connector to extract power, and the requirement for the positioning direction of the connecting portion 22 in the first inner core 11 is low, that is, the connector can be inserted into the first inner core 11 at any angle, which can ensure the reliability of power on, further simplifying the connection structure and facilitating the installation operation.

In addition, the first connecting assembly 1 includes the first housing 13. The first electric wires 12 are arranged inside the first housing 13, and the first inner core 11 is arranged at a first end portion of the first housing 13 in a penetration manner. The second connecting assembly 2 includes the second housing 23. The second electric wires 24 and the second inner core 21 are each arranged inside the second housing 23. The connecting portion 22 is arranged at a first end portion of the second housing 23 in a penetration manner. The first electric wire 12 and the first inner core 11 can be effectively protected by the first housing 13, and the second electric wire 24 and the second inner core 21 can be effectively protected by the second housing 23. Moreover, the first housing 13 and the second housing 23 can facilitate the fixing and installation of the connector in the Christmas tree tube, and provide a corresponding support for the connection between the first electric wire 12 and the second electric wire 24. The positioning hole 4 cooperating with the first inner core 11 is arranged in the first end portion of the second housing 23, the first inner core 11 extends into the positioning hole 4, and the connecting portion 22 is inserted into the second end portion of the first inner core 11. When the connecting portion 22 and the first inner core 11 are engaged with each other, the first housing 13 and the second housing 23 are close to each other and fixedly connected. The first inner core 11 passes through the first housing 13 and is positioned in the second housing 23, and the connecting portion 22 is inserted into the first inner core 11, so that the first inner core 11 is effectively wrapped by the first housing 13 and the second housing 23, and the quality of the connection between the connecting portion 22 and the first inner core 11 is reliably ensured.

In the present embodiment, the connector further includes the elastic member 5. A first end portion of the elastic member 5 is fixedly connected to the first end portion of the first inner core 11, a second end portion of the elastic member 5 is fixedly connected to the first housing 13, and the elastic member 5 is sleeved on the outer side of the first electric wires 12. Therefore, when the connecting portion 22 is engaged into the first inner core 11, the elastic member 5 can provide a certain rebound space for the connection between the connecting portion 22 and the first inner core 11. In this way, a poor contact situation can be avoided in the case where there is a positive and negative tolerance in the docking connection between the nodes when the connector is installed in the Christmas tree tube, which provides a certain adjustment room for the cooperation between the first connecting assembly 1 and the second connecting assembly 2 to ensure the reliable installation of the connector in the Christmas tree tube. It should be noted that, in the present embodiment, a spring is selected as the elastic member 5, which has a good elastic effect, but in other embodiments, the type selection of the elastic member 5 is not limited by the present embodiment. The type of the elastic member Scan be selected flexibly according to actual needs, as long as it can be ensured that a certain rebound is provided for the engagement between the connecting portion 22 and the first inner core 11.

Further, the first housing 13 includes the first segment 131 and the second segment 132, wherein the inner diameter of the first segment 131 is smaller than the inner diameter of the second segment 132, and the first segment 131 and the second segment 132 are sequentially connected. The first inner core 11 is arranged at a first end portion of the second segment 132 in a penetration manner. The first electric wires 12 are located in the first segment 131. The first segment 131 with a smaller inner diameter can effectively position each of the first electric wires 12 to provide a support for the first electric wires 12 and prevent the first electric wires 12 from being wound in the first segment 131. The second housing 23 includes the third segment 231 and the fourth segment 232, wherein the inner diameter of the third segment 231 is larger than the inner diameter of the fourth segment 232, and the third segment 231 and the fourth segment 232 are sequentially connected. The second inner core 21 is located in the fourth segment 232. The positioning hole 4 and the connecting portion 22 are both arranged in the third segment 231. The fourth segment 232 is used for positioning each of the second electric wires 24. The first end portion of the second segment 132 is fixedly connected to a first end portion of the third segment 231. When the connecting portion 22 is engaged with the first inner core 11, the first end portion of the second segment 132 and the first end portion of the third segment 231 are in contact with each other and are fixedly engaged, so that the first inner core 11 is wrapped between the second segment 132 and the third segment 231, providing an effective support for the entire connector. Moreover, the outer contour of the second segment 132 is consistent with the outer contour of the third segment 231. Thus, when the connecting portion 22 is fitted with the first inner core 11, since the outer side surface of the second end portion of the connecting portion 22 is an arc-shaped surface, the second segment 132 and the third segment 231 can be spliced at any angle without making specific requirements on the installation direction, simplifying the related installation operations of the operator. The elastic member 5 is located in the second segment 132. The step 6 is provided at the connection between the inner wall of the first segment 131 and the inner wall of the second segment 132. The second end portion of the elastic member 5 is abutted and connected to the step 6. The step 6 can provide a certain supporting force for the elastic member 5, which ensures that the elastic member 5 can be compressed along the axial direction of the first inner core 11, and improves the elastic force of the elastic member 5, thereby providing a rebound space when the first connecting assembly 1 and the second connecting assembly 2 are fitted with each other.

In addition, the first housing 13 includes two first half housings that are detachably engaged. The first bump 7 and the first groove 8 are provided on the side surfaces opposite to each other on the two first half housings fastened to each other, respectively. The two first half housings are detachably engaged through the engagement between the first bump 7 and the first groove 8. During the installation, one first half housing can be installed first, and after the corresponding first inner core 11 and the first electric wires 12 are positioned and installed inside the one first half housing, the other first half housing is engaged with the one first half housing. The second housing 23 includes two second half housings that are detachably engaged. The second bump 9 and the second groove 10 are provided on the side surfaces opposite to each other on the two second half housings fastened to each other, respectively. The installation of the second housing 23 is completed through the engagement between the second bump 9 and the second groove 10. The first housing 13 and the second housing 23 each adopt a detachable assembly structure, which can effectively simplify the operation and arrangement of the operator to install the connector inside the Christmas tree tube, and is also convenient to disassemble, maintain and replace the first inner core 11, the second inner core 21, the connecting portion 22, and the like in the first connecting assembly 1 and the second connecting assembly 2.

The connector of the present invention includes the first connecting assembly 1 and the second connecting assembly 2, which are fitted with each other. The first connecting assembly 1 includes the first inner core 11 and at least two first electric wires 12, and each of the first electric wires 12 is electrically connected in the first end portion of the first inner core 11. The second connection assembly 2 includes the second inner core 21 and at least two second electric wires 24, and each of the second electric wires 24 is electrically connected in the first end portion of the second inner core 21. The second end portion of the second inner core 21 is provided with the connecting portion 22, and the connecting portion 22 is inserted in the second end portion of the first inner core 11, so that the first electric wire 12 is in an electrical communication with the second electric wire 24. Thus, the multi-stage connection powered-on inside the Christmas tree tube can be ensured, and it is convenient for the powered-on connection in the tube to achieve more diverse functions. The structural design of the entire connector is very simple, making it convenient to produce and manufacture and easy to install, use and operate. When two segments of multi-stage electric wires need to be conducted, only the first connecting assembly 1 and the second connecting assembly 2 need to be simply spliced, which effectively ensures the reliability of the electrical connection between various electric wires in the tube and makes it suitable for promotion and use.

It should be understood that the terms such as "first" and "second" are used in the present invention to describe various kinds of information, but the information should not be limited to these terms, and these terms are only used to distinguish the same type of information from each other. For example, without departing from the scope of the present invention, "first" information may also be referred to as "second" information, and similarly, "second" information may also be referred to as "first" information.

Preferred implementations of the present invention are described above. It should be noted that for those skilled in the art, several improvements and modifications can be made without departing from the principle of the present invention, and these improvements and modifications shall fall the protective scope of protection of the present invention.

What is claimed is:

1. A connector, comprising a first connecting assembly and a second connecting assembly, wherein the first connecting assembly and the second connecting assembly are fitted with each other;

the first connecting assembly comprises a first inner core and at least two first electric wires, and each first electric wire of the at least two first electric wires is electrically connected in a first end portion of the first inner core;

the second connecting assembly comprises a second inner core and at least two second electric wires, and each second electric wire of the at least two second electric wires is electrically connected in a first end portion of the second inner core; and a second end portion of the second inner core is provided with a connecting portion, and the connecting portion is inserted in a second end portion of the first inner core, so that the each first electric wire is in an electrical communication with the each second electric wire;

wherein the first connecting assembly comprises a first housing, the at least two first electric wires are arranged inside the first housing, and the first inner core is arranged at a first end portion of the first housing in a penetration manner, the second connecting assembly comprises a second housing, the at least two second electric wires and the second inner core are each arranged inside the second housing, and the connecting portion is arranged at a first end portion of the second housing in a penetration manner, and a positioning hole for receiving the first inner core is arranged in the first end portion of the second housing, the first inner core extends into the positioning hole, and the connecting portion is inserted into the second end portion of the first inner core;

wherein the connector further comprises an elastic member, wherein a first end portion of the elastic member is fixedly connected to the first end portion of the first inner core, a second end portion of the elastic member is fixedly connected to the first housing, and the elastic member is sleeved on an outer side of the each first electric wire;

wherein the first housing comprises a first segment and a second segment, an inner diameter of the first segment is smaller than an inner diameter of the second segment, and the first segment and the second segment are sequentially connected; the first inner core is arranged at a first end portion of the second segment in a penetration manner;

the second housing comprises a third segment and a fourth segment, an inner diameter of the third segment is larger than an inner diameter of the fourth segment, and the third segment and the fourth segment are sequentially connected; the second inner core is located in the fourth segment, and the positioning hole and the connecting portion are both arranged in the third segment; and the first end portion of the second segment is fixedly connected to a first end portion of the third segment;

wherein the elastic member is located in the second segment a step is provided at a connection between an inner wall of the first segment and an inner wall of the second segment, and the second end portion of the elastic member is abutted and connected to the step.

2. The connector according to claim 1, wherein, the at least two first electric wires are arranged side by side, and the at least two second electric wires are arranged side by side.

3. The connector according to claim 2, wherein, an output terminal in an electrical communication with the each first electric wire is arranged inside the first inner core; the connecting portion is electrically connected to the each second electric wire, and the connecting portion is inserted into the second end portion of the first inner core and is electrically connected to the output terminal.

4. The connector according to claim 3, wherein, a limiting hole is arranged in the second end portion of the first inner core; a first end portion of the connecting portion is fixedly connected on the second end portion of the second inner core, a second end portion of the connecting portion is inserted into the limiting hole, and an outer side surface of the second end portion of the connecting portion is an arc-shaped surface.

5. The connector according to claim 2, wherein, a limiting hole is arranged in the second end portion of the first inner core; a first end portion of the connecting portion is fixedly connected on the second end portion of the second inner core, a second end portion of the connecting portion is inserted into the limiting hole, and an outer side surface of the second end portion of the connecting portion is an arc-shaped surface.

6. The connector according to claim 1, wherein, a limiting hole is arranged in the second end portion of the first inner core; a first end portion of the connecting portion is fixedly connected on the second end portion of the second inner core, a second end portion of the connecting portion is inserted into the limiting hole, and an outer side surface of the second end portion of the connecting portion is an arc-shaped surface.

7. The connector according to claim 1, wherein, the elastic member is a spring.

8. The connector according to claim 1, wherein, the first housing comprises two first half housings and the two first half housings are detachably engaged; the second housing comprises two second half housings and the two second half are detachably engaged.

* * * * *